United States Patent [19]

Pezzner et al.

[11] Patent Number: 4,523,888

[45] Date of Patent: Jun. 18, 1985

[54] COMBINED ENGINE-HANDLING AND METALWORKING MACHINE

[75] Inventors: Richard S. Pezzner, Northridge; George L. Rader, Sun Valley, both of Calif.

[73] Assignee: RSP Innovation Design Mfg., Inc., No. Hollywood, Calif.

[21] Appl. No.: 574,005

[22] Filed: Jan. 26, 1984

[51] Int. Cl.[3] ..... B30B 1/04

[52] U.S. Cl. ..... 414/680; 254/8 B; 29/251; 29/401.1; 100/103

[58] Field of Search ..... 100/103; 414/680; 29/252, 251, 401.1; 254/8 B

[56] References Cited

U.S. PATENT DOCUMENTS

| | | | |
|---|---|---|---|
| 3,111,752 | 11/1963 | Simmons | 29/252 |
| 3,158,269 | 11/1964 | Corso | 414/680 |
| 3,359,618 | 12/1967 | Murphy | 29/252 X |
| 3,367,512 | 2/1968 | Kaplan | 414/680 X |
| 3,667,632 | 6/1972 | Tidswell | 414/680 |
| 3,797,675 | 3/1974 | Moore | 254/8 B X |
| 4,021,017 | 5/1977 | Adams | 254/8 B |

*Primary Examiner*—Terrance L. Siemens
*Attorney, Agent, or Firm*—Larry F. Gitlin

[57] ABSTRACT

A portable combined engine-handling and metalworking machine having a base with wheels and casters, a vertical post or mast extending from the base to support a boom to form a hydraulically activated crane or hoist, an engine stand to support a motor or like object, and a hydraulic press and press assembly, which is formed from parts that are interchangeable with parts from the hydraulically activated crane.

5 Claims, 3 Drawing Figures

60
74
73
36
53
47
35
54
72
52
45
58
70
57
56
66
69
51
49
48
39
43
62
64
41
42
38
63
34
61
44
46
71
37
40
28
26
27
21
22
2
18
19
20
30
24
32
23
4
25
15
16
17
6
8
10
12
14
32

COMBINED ENGINE-HANDLING AND METALWORKING MACHINE

BACKGROUND OF THE INVENTION

1. Field of the Invention

The present invention relates to a combination engine-handling and metalworking machine, and more particularly to a portable machine that can be conveniently and quite easily assembled, disassembled and maneuvered to facilitate the lifting and handling of and metalworking on all kinds of engines, transmissions and other types of objects normally found in marine, aviation, machine and automotive shops, vehicle repair shops, garages and other locations.

2. Description of the Prior Art

Jacks, hoists, cranes and engine stands are known to exist in the prior art. Examples of U.S. Patents which disclose devices of the kind already mentioned include the following U.S. Pat. Nos.: 1,331,938, McConnell, et al.; 1,614,697, Snook; 3,059,785, Buckeye; 3,797,675, Moore; 4,099,634, McIntire, et al.; 4,190,233, Godfrey.

The prior art discloses devices such as jacks or cranes, which are used for lifting or lowering engines and the like from automobiles; engine stands, which are used to hold an engine in place while it undergoes repair or rebuilding; and dollies which are normally mounted on wheels and casters and serve to support the cranes and engine stands while also providing the means to easily maneuver them around the shop.

However, to applicant's knowledge, the prior art does not disclose any device that is so clearly portable that it may be assembled or disassembled in only a few minutes and stored in a compact container, which may be used to transport the invention with relative ease and convenience. Moreover, the prior art does not disclose any such devices or assemblage of devices which are combined together with a shop press, such that, for example, the entire engine or transmission repair or rebuilding process can be completed without resorting to the use of a much less mobile, compact and independent system. Existing devices are clearly not designed to permit the ease of assembly and disassembly that the present invention provides, nor do any of them include the convertible feature of the present invention such that the hydraulic shop press and the crane or hoist assembly are assembled using interchangeable parts.

SUMMARY OF THE INVENTION

The present invention of a portable combined engine-handling and metalworking machine comprises a base supported by wheels and casters for ease of maneuverability, a vertical post or column extending from the base to support a boom to constitute a crane or hoist assembly usually associated with vehicles or the like; and, a convertible shop press, which is formed, in substantial part, from specially fabricated parts which are interchangeable with those that are used to construct the crane assembly and vice versa.

The primary object of the invention is to provide a portable engine-handling and metalworking machine that combines a crane, engine stand, shop press and dolly that can be quickly and easily assembled and disassembled to greatly facilitate different types of work that may be performed around a marine, aviation, machine and automotive repair shop or the like.

Another object of the invention is to provide a device that can be quickly and conveniently converted from a hydraulically activated crane or hoist, which is used to lift or lower and remove the likes of engines, manifolds, transmission, or heavy air conditioning units from automobiles or other vehicles, to a hydraulic shop press, which is designed for all types of automotive and industrial applications, such as, for example, for straightening, bending and pressing a variety of engine parts towards rebuilding or repairing the engine.

Still another object of the invention is to provide a device which can be quickly disassembled and stored in a relatively small case or container that can be transported from place to place with relative ease as required or desired.

Still another object of the invention is to provide a versatile engine-handling and metalworking machine that is rugged in structure and relatively simple and inexpensive to manufacture.

Other objects and advantages will become apparent in the following specifications when considered in light of the attached drawings wherein a preferred embodiment of the inventions is illustrated.

DESCRIPTION OF THE PREFERRED EMBODIMENT

Figure 1:
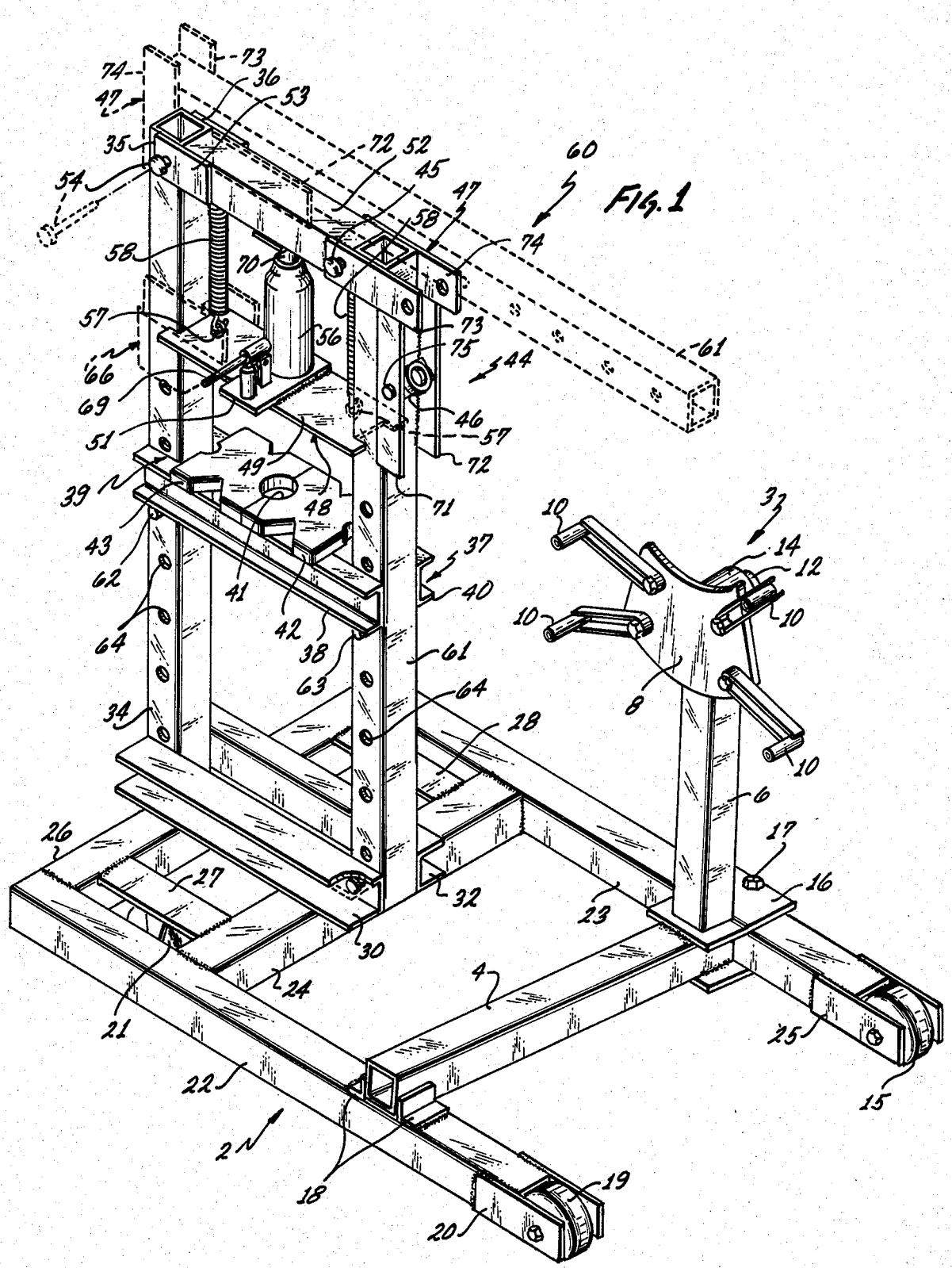
FIG. 1 is a perspective view of the present invention.
Figure 2:
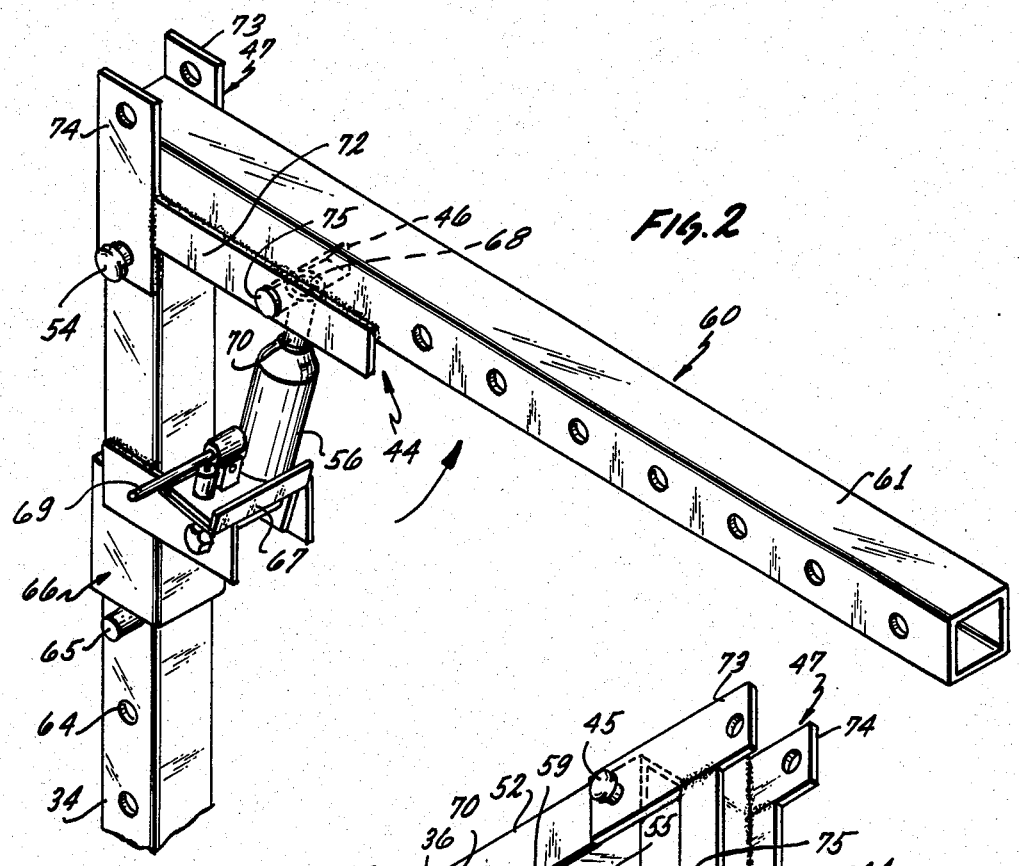
FIG. 2 is a fragmentary sectional view of the present invention showing the crane boom and certain of its associated parts.
Figure 3:
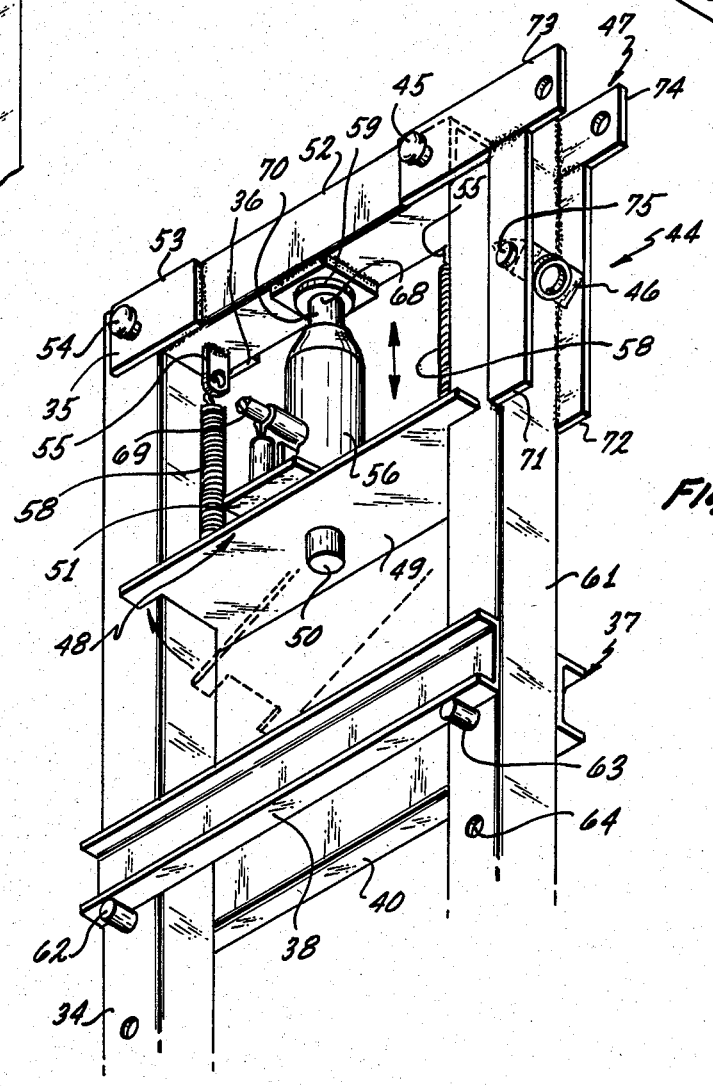
FIG. 3 is a fragmentary sectional view showing the convertible shop press and certain of its associated parts.

Referring now to the drawings in detail, the portable combination engine-handling and metalworking machine in one form is depicted in FIG. 1. A fragmentary view of the crane assembly of the invention, with associated parts, is depicted in FIG. 2. A fragmentary view of the press assembly of the invention, with associated parts, is depicted in FIG. 3.

The reference numeral 2 indicates generally the base or principal support structure of the present invention. Base 2 includes a pair of horizontally disposed spaced parallel hollow beams 22 and 23, and spaced apart cross beams 24 and 26 which extend in perpendicular relation to and between beams 22 and 23 and are secured thereto. Extending from the respective ends of beams 22 and 23 furthest from cross beams 24 and 26 are wheel-housings 20 and 25 and respective wheels 15 and 19 mounted therein. Between beams 24 and 26 are secured caster mounts 27 and 28 and underlying casters 21, which are attached thereto. Except for the casters 21 and wheels 15 and 19, the foregoing elements are secured to their associated parts by welding, but may be secured by other conventional means that may prove to be more effective or convenient. The wheels 15 and 19 and casters 21 are mounted within their respective housings by conventional means.

Extending vertically from the base 2 is the crane mast 34 which is secured by a weld to channel beams 30 and 32. Channel beams 30 and 32 extend across beams 24 and 26 and are suitably secured thereto by conventional means, such as by a nut and bolt. Secured to the uppermost end of mast 34 by conventional means, such as by pin 54 inserted into a corresponding opening (not shown), is crane boom 61. The combination of mast 34 and crane boom 61, with their associated parts shown in FIG. 1, constitute the crane assembly 60. Jack head assembly 44 containing the jack head bracket 46 is provided for receiving and supporting the head of the hydraulic cylinder 56 when used in conjunction with the operation of crane assembly 60. Jack head assembly 44 includes two rectangular shaped metal plates 71 and 72, which are secured by a weld to the edges of crane boom 61 towards one end thereof, and a jack head bracket 46 which is secured between plates 71 and 72 by a pin 75. Flange 47, which includes two rectangular shaped metal plates 73 and 74, is secured to the end of crane boom 60 in perpendicular relation to plates 71 and 72, which are in turn joined to plates 73 and 74 by a weld or other conventional means. Flange 47 is provided to receive the uppermost end of mast 34 when used in conjunction with crane boom 61 to form crane assembly 60. The end of mast 34 is pivotally connected to the crane boom 61 as at 53. As shown in FIG. 2, a hydraulic jack 56 is adjustably mounted onto the jack base seat 67 of the jack base assembly 66, which is secured to mast 34 by pin 65 that is inserted into a corresponding opening (not shown). The jack head 68 is inserted and secured to the jack head bracket 46, which is mounted within jack head assembly 44. A hook or heavy link chain with a hook attached to it is secured to the end of the crane boom 61 for eventual engagement with an object intended to be lifted and removed from its source, such as an engine or transmission from an automobile, boat or airplane.

Press 39 is mounted upon base 2 in a manner generally similar to that of crane assembly 60 with certain exceptions. Mast 34 and the crane boom 61 extend vertically in spaced parallel relation to be joined at their top ends by press head assembly 52. Press head assembly 52 includes flange 53, which is comprised of rectangular shaped metal plates 35 and 36 which engage the uppermost end of mast 34 and are secured thereto by pin 54. The opposite end of press head assembly 52 engages flange 47 and is secured thereto by pin 45 which is inserted into a corresponding opening (not shown). On the underside of press head assembly 52 is press head bracket 59 which engages and secures the jack head 68. Press head assembly 52 also includes spring tab supports 55 on either end of the underside thereof. Supporting the weight of hydraulic jack 56 is press jack base assembly 48, which includes ram guide 49 to receive and secure jack base 51, and spring hook eyebolts 57. Return springs 58 are attached at either end thereof to spring tab supports 55 and spring hook eyebolts 57, respectively. Extending downward through the approximate center of press jack assembly is ram 50.

Located below press jack base assembly 48 are press plates 42 and 43 with multiple adjustable openings 41. Press plates 42 and 43 are supported by press bed 37 comprising channel beams 38 and 40, which are connected to each other by welded cross pieces (not shown) and supported thereunder by support pins 62 and 63 inserted in corresponding openings (not shown).

Engine stand 3 is formed with the engine stand base 4 extending diagonally across from beam 23 to beam 22 and stabilized on beam 22 by flange 18 attached to opposite sides of the end of beam 22. Slide bracket 16 engages beam 23 and is secured thereto by bolt 17, which is inserted into a corresponding opening (not shown). Slide bracket 16 is secured to engine stand base 4 by a weld, although other suitable conventional means may be utilized. Engine stand mast 6, which is mounted on and extends vertically from one end of engine stand base 4 includes horizontal sleeve 14 at the uppermost end thereof. Sleeve 14 receives rod 12, which in turn is attached to engine stand plate 8. Plate 8 is in a vertical plane and has a plurality of pivoted arms and bolts 10 that may be adjusted, for example, for attachment to the transmission plate of a motor, the number and angle of the bolt being selected according to the particular requirement. Engine stand plate 8 is secured to the horizontal sleeve 14 by conventional means as by a nut and bolt.

The present invention can be used for many purposes as for example as a crane for lifting and lowering heavy parts of a vehicle, such as an engine, transmission or the like, from positions above and below the chassis of the vehicle. The crane is particularly useful for people working in vehicle repair stations, garages or the like, though it may also be advantageous wherever there is a need to lift and/or lower a heavy load of the type already described.

The present invention can also be used as an engine stand to which an engine, transmission or the like can be mounted and held, for example, for repairs or rebuilding.

The present invention can also be used as a convertible shop press designed for automotive, industrial and general applications. The press can straighten, bend and press and is capable of such applications as the removal and installation of gears, axle bearings, wrist pins, drive shaft bearings and universal joints.

In the use of the invention, crane assembly 60 mounted on the base 2 is rolled on casters 21 and wheels 15 and 19 close to the front end of an automobile or like vehicle. Beams 22 and 23 are then moved under the vehicle chassis and crane boom 61 is maneuvered overhead the object to be lifted or lowered. In this example, the object selected is an engine. A chain that is connected and hanging from crane boom 61 is then attached to the engine. Jack handle 69 is then worked up and down several times to increase the hydraulic pressure in jack 56, thus causing plunger 70 to extend forcing crane boom 61 upwards to lift the engine from the chassis. After the engine is lifted free of the vehicle, base 2 is removed from under the chassis. Engine stand 3 is then mounted securely upon beams 22 and 23, whereupon the engine is moved into position in front of plate 8 for alignment with pivoted arms and bolts 10, which are then brought into contact with and attached to the end of the engine and secured thereto.

For metalworking, press 39 is conveniently and quickly assembled using interchangeable parts from the crane assembly 60. Crane boom 61 is first disconnected from mast 34 and the associated parts of crane assembly 60, such as hydraulic jack 56, jack base assembly 66 and jack base seat 67, are then removed or disassembled. Crane boom 61 is oriented vertically and then mounted and secured to base 2 between channel beams 30 and 32 Crane Boom 61 is joined at the top end thereof with press head assembly 52 and secured thereto with pin 45. Flange 53 engages the opposite end of press head assembly 52 with the uppermost end of the mast 34 and is secured thereto by pin 54. The associated parts of press 39, including hydraulic jack 56, jack handle 69, press jack base assembly 48, return springs 58, press plates 42 and 43 and press bed 37, are then assembled and positioned making press 39 operational.

It will thus be seen that the present invention provides a portable combination crane, shop press, engine stand and dolly which is especially suitable in a vehicle repair shop or the like for use in removing, repairing and moving about a heavy object, such as an automobile engine or transmission. The hydraulic mechanism used in conjunction with the crane to lift and lower a heavy object, such as an engine or transmission, from an automobile is also used in conjunction with the shop press, which is easily assembled using parts that are interchangeable with the crane assembly, particularly the boom.

Wheels 15 and 20 and casters 21 are mounted on base 2 to improve maneuverability. The use of wheels 15 and 19 and casters 21 minimize the physical effort needed to move the invention about.

All the parts of the present invention are constructed so that they are easily assembled in a quick and convenient manner and, thereafter, can be stored in a relatively confined area or container.

Having thus described the preferred embodiment of the invention it should be understood that numerous structural modifications and adaptations may be resorted to without departing from the spirit of the invention.

What is claimed is:

1. A combination engine-handling and metalworking machine comprising:

a. A support structure, said support structure comprising a pair of horizontally disposed spaced parallel hollow beams each of which is connected at one end thereof to wheels and interconnected at the opposite end thereof by a pair of first and second cross pieces, said cross pieces being joined near the ends thereof by caster mounts with underlying casters, b. A crane means which may be erected thereon, said crane means comprising a vertical post having horizontally disposed spaced parallel channel beams attached to and extending from the lower end of said post in spaced parallel relation to and in between said pair of hollow beams, said post being mountable upon said first and second cross pieces; a boom attached to the upper end of said vertical post and extending generally in perpendicular relation thereto; and power means for pivoting said boom about said vertical post, said power means having a top and base portion;

c. A carrying means that may be erected upon said support structure to which an engine or other object may be secured;

d. A press means, including said vertical post, said boom that is adaptable as a stanchion for use with said press means, said boom being joined and secured at the bottom end thereof to the ends of said horizontally disposed spaced parallel channel beams that are opposite the ends of said channel beams attached to said vertical post; a third horizontally disposed cross piece extending above and in spaced parallel relation to said horizontally disposed spaced parallel channel beams and connected at each end thereof to the top ends of said vertical post and said boom, respectively, said third cross piece comprising means for receiving and securing said top portion of said power means; first and second springs; first means for attachment of the upper ends of said first and second springs to said third cross piece; a horizontally disposed guide member having ends that engage said vertical post and said boom to permit slidable vertical movement thereof, said member including means thereon for receiving and securing said base portion of said power means, which is adaptable for use with said crane means to raise and lower said boom; a second means for attachment of said guide member to the lower ends of said first and second springs; fourth and fifth horizontally disposed spaced parallel cross pieces that engage and are secured to said vertical post and said boom; and a pair of press plates that are supported by said fourth and fifth cross pieces.

2. The invention of claim 1 in which said power means comprises a hydraulic cylinder.

3. The invention of claim 2 in which said boom includes means for adapting said boom for release from said press means for mounting to said top end of said vertical post to comprise said crane means.

4. The invention of claim 3 in which said means for adapting said boom comprises first and second spaced parallel rectangular members affixed to the upper end of said boom along the vertical axis thereof and third and fourth spaced parallel rectangular members affixed to said top end of said boom in contact with and in generally perpendicular relation to said first and second rectangular members, said third and fourth members including a first and second collar means on each end thereof for receiving said end of said third cross piece to adapt said boom for use with said press means and said top end of said vertical post to adapt said boom for use with said crane means, respectively.

5. The invention of claim 4 wherein said carrying means comprises a third hollow beam member that extends between said pair of hollow beams in generally perpendicular relation thereto, said third hollow beam including means on one end thereof for stabilizing said end upon the top of one of said pair of hollow beams and means on the opposite end thereof to receive and secure said carrying means to said second beam of said pair of hollow beams, said third hollow beam being joined at said opposite end by a mast extending vertically therefrom, said mast including at the top thereof means to engage and secure said engine or other object to said carrying means.

* * * * *